US009187930B2

(12) United States Patent
Mayer et al.

(10) Patent No.: US 9,187,930 B2
(45) Date of Patent: Nov. 17, 2015

(54) ARRESTING AND INTERLOCKING UNIT FOR A PARTITION WALL SYSTEM, AS WELL AS A PARTITION WALL SYSTEM

(71) Applicants: Mark Mayer, Bad Salzuflen (DE); Thomas Vogler, Bad Salzuflen (DE); Ralf Kreyenborg, Bad Salzuflen (DE); Oliver Walhorn, Werther (DE); Jörg Sunderbrink, Bad Oeynhausen (DE)

(72) Inventors: Mark Mayer, Bad Salzuflen (DE); Thomas Vogler, Bad Salzuflen (DE); Ralf Kreyenborg, Bad Salzuflen (DE); Oliver Walhorn, Werther (DE); Jörg Sunderbrink, Bad Oeynhausen (DE)

(73) Assignee: Dorma Deutschland GmbH, Ennepetal (DE)

( * ) Notice: Subject to any disclaimer, the term of this patent is extended or adjusted under 35 U.S.C. 154(b) by 0 days.

(21) Appl. No.: 14/222,085

(22) Filed: Mar. 21, 2014

(65) Prior Publication Data

US 2014/0290141 A1 Oct. 2, 2014

(30) Foreign Application Priority Data

Mar. 26, 2013 (DE) ..... 10 2013 103 046

(51) Int. Cl.

| | |
|---|---|
| ***E05C 3/16*** | (2006.01) |
| ***E05B 63/12*** | (2006.01) |
| ***E04B 2/82*** | (2006.01) |
| ***E05B 47/02*** | (2006.01) |
| ***E05B 63/14*** | (2006.01) |
| ***E05B 65/08*** | (2006.01) |
| ***E06B 3/50*** | (2006.01) |
| *E05D 15/06* | (2006.01) |
| *E05B 47/00* | (2006.01) |
| *E04B 1/61* | (2006.01) |

(52) U.S. Cl.

CPC ..... *E05B 63/123* (2013.01); *E04B 2/827* (2013.01); *E05B 47/023* (2013.01); *E05B 63/14* (2013.01); *E05B 65/0811* (2013.01); *E06B 3/5072* (2013.01); *E04B 1/6183* (2013.01); *E05B 2047/0021* (2013.01); *E05D 15/0604* (2013.01); *E05Y 2201/22* (2013.01); *E05Y 2600/322* (2013.01); *E05Y 2600/62* (2013.01); *E05Y 2800/73* (2013.01); *Y10T 292/0945* (2015.04)

(58) Field of Classification Search

CPC ... E05B 63/123; E05B 63/14; E05B 65/0811; E05B 47/023; E05B 2/827

USPC ..... 49/127, 177–185, 409

See application file for complete search history.

(56) References Cited

U.S. PATENT DOCUMENTS

| | | | | | |
|---|---|---|---|---|---|
| 782,139 | A | * | 2/1905 | Jones | 49/177 |
| 1,085,065 | A | * | 1/1914 | Speicher | 49/177 |
| 1,294,949 | A | * | 2/1919 | Roberts | 70/120 |
| 2,052,089 | A | * | 8/1936 | Fairhurst | 49/127 |

(Continued)

FOREIGN PATENT DOCUMENTS

| | | | |
|---|---|---|---|
| DE | 31 48 464 | A1 | 12/1982 |
| DE | 35 22 824 | C1 | 8/1986 |
| EP | 0 562 073 | B1 | 9/1993 |

*Primary Examiner* — Katherine Mitchell
*Assistant Examiner* — Justin Rephann
(74) *Attorney, Agent, or Firm* — Cozen O'Connor

(57) ABSTRACT

An adjusting and interlocking unit for displaceable and pivotable doors and/or walls, which are guided to be movable at and/or in a roller rail via rollers, includes an upper part, attachable to the roller rail, a central part attachable to a movable carriage profile of a door respectively of a wall, and a lower part attachable to the door, respectively to the wall. A locking element allows for releasing or interlocking the doors and/or wall.

14 Claims, 5 Drawing Sheets

(56) References Cited

U.S. PATENT DOCUMENTS

| | | | | | |
|---|---|---|---|---|---|
| 2,202,916 | A | * | 6/1940 | Mussa | 292/177 |
| 3,060,521 | A | * | 10/1962 | Greco | 52/65 |
| 3,235,915 | A | * | 2/1966 | Glaser | 52/64 |
| 3,279,123 | A | * | 10/1966 | John Genison | 49/127 |
| 3,354,581 | A | * | 11/1967 | Kessner et al. | 49/141 |
| 3,466,805 | A | * | 9/1969 | Muessel | 49/141 |
| 3,685,223 | A | * | 8/1972 | Sherwood | 52/64 |
| 3,750,334 | A | * | 8/1973 | Slaybaugh | 49/177 |
| 3,883,164 | A | * | 5/1975 | Galbreath et al. | 292/92 |
| 4,438,594 | A | * | 3/1984 | Bunzl | 49/177 |
| 4,555,828 | A | | 12/1985 | Matimura | |
| 4,752,987 | A | | 6/1988 | Dreyer et al. | |
| 5,394,648 | A | | 3/1995 | Kordes | |
| 5,577,348 | A | * | 11/1996 | Keller | 49/317 |
| 8,590,233 | B2 | * | 11/2013 | Sprague | 52/243.1 |
| 8,756,865 | B2 | * | 6/2014 | Nicholson et al. | 49/180 |
| 2009/0241445 | A1 | * | 10/2009 | Sprague | 52/243.1 |
| 2009/0241493 | A1 | * | 10/2009 | Sprague | 55/493 |
| 2010/0111598 | A1 | * | 5/2010 | Baur et al. | 403/348 |

* cited by examiner

ARRESTING AND INTERLOCKING UNIT FOR A PARTITION WALL SYSTEM, AS WELL AS A PARTITION WALL SYSTEM

BACKGROUND OF THE INVENTION

1. Field of the Invention

The invention relates to an arresting and an interlocking unit for displaceable and pivotable doors and/or walls, which are attached so as to be movable via rollers to/in a roller rail. Furthermore, the invention relates to a partition wall system, including a roller rail, two or more displaceable and pivotable doors and/or walls, which are guided to be movable via rollers at and/or in the roller rail, for each door or wall at least one movable carriage profile to which one or more rollers are attached, as well as an adjusting and interlocking unit for at least one of the doors or walls.

2. Description of the Related Art

A system composed of sliding walls, respectively sliding doors, includes fixedly mounted roller rails with corresponding rail branches which allow for displacing parts of or the entire unit disposed thereunder, in other words in particular one or more sliding leaves of the partition wall system, or to park them in a side position. This will always occur in the event a space, for example, needs to be separated or else if a space needs to be subdivided into several smaller spaces. Another application area of a partition wall system made from sliding walls, respectively sliding doors, is nowadays found more and more in the utilization of door wall elements in the area of restaurants and business premises. In this case, depending on the weather conditions, the entire door wall frontage can be removed or else only parts of the door frontage can be displaced or pivoted to the side.

Partition wall systems, respectively systems composed of sliding walls or sliding doors of this species, can be found in the documents DE 35 22 824 A1 as well as DE 31 48 464 A1. In order to be able to modify this type of installation fast and without major expenditure of forces, the partition wall elements, respectively the door wall elements, are equipped with so-called arresting devices, which are located at the upper end of an element and can be released or arrested by protracting, respectively retracting an interlocking device. However, this action becomes difficult, if, in case of high partition wall systems of more than 2 meters measured from above the ground, not every person will still be able to reach the interlocking device without the help of ladders or the like.

In currently known systems with displaceable and/or pivotable doors and/or walls, in particular in the area of horizontal sliding walls, respectively sliding doors, one element, respectively one swing/sliding leaf is currently secured by an arresting and interlocking unit, which includes two screws, wherein the screws are screwed by their thread into a corresponding counter-piece by a rotating movement. An arresting and interlocking unit of this species for displaceable and/or pivotable doors and/or walls is known for example from the document EP 0 562 073 B1. The arresting and interlocking unit consists of an upper part, a central part and a lower part, which are placed one below the other. The three parts are affixed to the outside of the door installation by fastening screws. In this case, respectively one screw for the arresting procedure and for the interlocking procedure is located in the unit. The screws are operated from the ground by an articulated handle, which, at its upper end, has a ball head hexagon socket screw wrench. Both the arresting screw and the interlocking screw can be screwed in or out by the ball head hexagon socket screw wrench.

If, for example a door, respectively a door wall element needs to be closed, the arresting screw, which is located in the central part of the unit, is screwed into the upper part of the unit by a rotating movement, which part is attached to the roller rail of the door wall system. Thereby, two parts of the unit, namely the upper and the lower parts, are connected to each other, and the door leaf cannot be laterally moved any more. In order to be able to secure the swung-out condition of the door leaf, so to say essentially vertically to the lateral displacement, the second interlocking screw, which is located in the lower part of the unit, can be screwed into the central part of the unit. The type of screw connection allows for arresting the entire door, respectively a door element. Upper, central and lower parts form one single unit.

Now, in case a swing/sliding leaf needs to be brought into a parking position, the arresting connection needs to be released correspondingly and the swing/sliding leaf can be displaced within the roller rail. In case only swinging of the swing/sliding leaf is desired, the connection of the arresting screw to the roller rail needs to be maintained. Furthermore, the arresting screw needs to be unscrewed from the central part, and the swing/sliding leaf, respectively the entire swing/sliding leaf frontage is not arrested in its pivoting range. Articulated handles are utilized for operating the screws. The potential of hazard when adjusting the arresting and interlocking devices is reduced to almost zero, in particular because no additional devices need to be used.

If, however, one of the screws is not properly screwed in, the thread of the corresponding screw is adversely affected. The circumstance may result in a complete deformation of the thread and thereby of the screw such that the corresponding screw cannot be screwed any more into the upper part or the central part. In particular on account of the order of operation, the ease of operation is not optimal. As a consequence, it is no longer possible to prevent a door or a wall from pivoting and/or from being displaced, such that the entire partition wall system becomes instable.

SUMMARY OF THE INVENTION

Therefore, it is an object of the present invention to at least partially eliminate the above described disadvantages of known arresting and interlocking units for displaceable and pivotable doors and/or walls, which are attached to/in a roller rail to be movable via rollers, respectively of known partition wall systems. It is in particular the object of the present invention to provide an arresting and interlocking unit of the species mentioned in the introduction, respectively a partition wall system, which guarantees in a user-friendly, simple and reliable manner that a displaceable and pivotable door or wall can be optionally positioned so that the door or the wall can take one of the following conditions:

(1) Sliding is blocked and rotating is enabled, (2) Sliding and rotating are blocked, (3) Sliding is enabled and rotating is blocked.

According to the invention, the above problem is solved by an adjusting and interlocking unit having the features described in the description and the drawings. In this case, features and details, described in conjunction with the inventive adjusting and interlocking unit, are obviously also valid in conjunction with the inventive partition wall system and respectively vice versa, such that mutual reference is made with respect to the disclosure of individual aspects of the invention, respectively can be made.

According to a first aspect of the invention, the problem is solved by an adjusting and interlocking unit for displaceable and pivotable doors and/or walls, which are attached to/in a roller rail to be movable via rollers. In other words, the adjusting and interlocking unit is intended for such doors respectively walls, respectively adapted to be employed with them. The adjusting and interlocking unit includes an upper part, which can be attached to the roller rail, a central part, which can be attached to a movable carriage profile of a door, respectively of a wall, and a lower part, which can be attached to the door, respectively to the wall. Furthermore, the adjusting and interlocking unit is characterized in that it comprises arresting structure. According to an aspect of the invention, the adjusting and interlocking unit is adapted to arrest the central part at the upper part, however not at the lower part, by adjusting the one arresting structure in a first setting. In other words, with regard to the central part, the lower part remains freely movable, whereas the movement of the upper part with regard to the central part is prevented in at least one direction. The adjusting and interlocking unit is furthermore adapted to arrest the central part at the upper part and at the lower part by adjusting the arresting structure in a second setting. In other words, in this setting, the upper part and the lower part are prevented from a respective movement with regard to the central part, respectively in at least one direction. Finally, the adjusting and interlocking unit is adapted to arrest the central part at the lower part, however not at the upper part, by adjusting the arresting structure in a third setting. In other words, the upper part is now freely movable with regard to the central part, whereas the movement of the lower part with regard to the central part is prevented in at least one direction. As only one element needs to be adjusted in order to effect all three settings, the operation is considerably simplified.

Preferably, the arresting structure is configured by a rotatably supported locking element. The locking element is rotatably supported at the central part around an axis of rotation. In other words, the aforementioned adjusting is realized by rotating the locking element as the arresting structure. According to an aspect of the invention, furthermore an adjusting mechanism is provided by which the locking element is rotatably disposed alternating between respective positions, which correspond to the first, second and third settings. In a first position, the locking element engages in or at the upper part for arresting the central part at the upper part, such that the adjusting and interlocking unit is located in the aforementioned first setting. In the second position, the locking element engages in or at the upper part and in or at the lower part, for arresting the central part at the upper part and at the lower part, such that the adjusting and interlocking unit is located in the aforementioned second setting. In the remaining third position, the locking element engages in or at the lower part, for arresting the central part at the lower part, such that the adjusting and interlocking unit is located in the third setting. This arrangement is a particularly user-friendly embodiment. Only one rod is required, which, for example similar to a rotating pole for an awning, just needs to rotate the locking element in order to achieve the aforementioned three settings of the inventive adjusting and interlocking unit.

Thus, by such configured adjusting and interlocking unit and by a simple rotational movement of the locking element, it can be guaranteed that the locking element is able to take the three different settings. Thereby, in case of a displaceable and pivotable door or wall, a so-called swing/sliding leaf, the desired locking types can be simply and reliably achieved. In the first setting of the locking element, the locking element engages in or at the upper part such that displacing a swing/sliding leaf is thereby blocked, however a rotation is possible. In the second setting, the locking element engages both in or at the upper part and in or at the lower part, such that a swing/sliding leaf, to which the adjusting and interlocking unit is attached, is prevented from being displaced and rotated, respectively pivoted. In the third setting, the locking element prevents the swing/sliding leaf from being rotated, respectively pivoted, however allows for displacing the swing/sliding leaf.

Above and in the following description, both a displaceable and pivotable door and a displaceable and pivotable wall are likewise identified as a swing/sliding leaf.

The swing/sliding leaves are movable via rollers, which are disposed at one or more carriage profiles, and are guided at and/or in a roller rail. The upper part of the adjusting and interlocking unit serves as the attachment to the roller rail. In particular the upper part is non-positively and if required likewise positively connected to the stationary roller rail via a roller rail attachment. The central part or the adjusting and interlocking unit is attachable to a carriage profile. One or more rollers, which are guided at or in the roller rail, are disposed at the carriage profile, in order to displace a respective swing/sliding leaf along the roller rail. Preferably, the central part can be non-positively and if required likewise positively attached to the carriage profile via an attachment. The lower part of the adjusting and interlocking unit is directly or indirectly attached to the swing/sliding leaf, in other words to a door or to a wall. In this case, the lower part can be directly attached to the swing/sliding leaf or can be indirectly attached to the swing/sliding leaf, for example by a frame attachment. In particular screw elements serve as the frame attachment.

The locking element of the adjusting and interlocking unit is rotatably supported at the central part. Preferably, the locking element is supported at the central part such that it can be rotated parallel to the central part. The locking element includes in particular a flat base body. The locking element may be rotated by the adjusting mechanism of the adjusting and interlocking unit. In this case, the adjusting mechanism can move the locking element into the first setting, into the second setting or into the third setting. In the first setting, the locking element connects the central part to the upper part such that the two cannot be displaced any more with regard to each other. In the first setting, the locking element does not engage in or at the lower part, such that the swing/sliding leaf can be pivoted, respectively rotated. In the second setting, the locking element blocks both the lower part and the upper part of the adjusting and interlocking unit such that the swing/sliding leaf is blocked against displacing and pivoting. In the third setting, the locking element releases the upper part such that displacing the swing/sliding leaf is enabled, however, on account of the engagement at the lower part, the swing/sliding leaf is prevented from pivoting.

The adjusting and interlocking unit increases the comfort of operation for arresting and releasing a pivoting and a displacement of a displaceable and pivotable door or wall of a partition wall system, in particular of a horizontal partition wall system.

The inventive adjusting and interlocking unit is furthermore advantageous in that the different settings and therefore the different types of locking of the swing/sliding leaf can be achieved by one manipulation. Thereby, the swing/sliding leaf can be simply and quickly conveyed into a predetermined position, respectively can be blocked by a predetermined type of locking. In particular by reducing the two screw connections to a single locking element for the adjusting and interlocking unit, a false manipulation of the adjusting and interlocking unit and the thus linked upper interlocking of the swing/sliding leaf of a partition wall system can be prevented. A single rotating manipulation allows the adjusting and interlocking unit to occupy three different settings, in order to achieve the required locking types, namely:

(1) Rotating is enabled and sliding is blocked.

(2) Rotating and sliding are blocked.

(3) Rotating is blocked and sliding is enabled.

In light of the invention, an engagement of the locking element in or at the upper part means that the locking element is arrested at the upper part. This may take place by engaging the locking element into the upper part or by engaging the locking element at the upper part.

According to a preferred further development of the invention, it may be intended in an adjusting and interlocking unit that the upper part includes a reception, in particular a depression or a groove for engagement, in particular for a positive engagement of a first part of the locking element. The upper part, the central part and the lower part of the adjusting and interlocking unit are disposed to be preferably vertical underneath each other, namely along a direction of the roller rail towards the respective swing/sliding leaf. The reception in the upper part is preferably disposed at the side of the upper part oriented towards the central part. By rotating the locking element by the adjusting mechanism, the locking element engages positively in the reception. The first setting is reached in this condition. On account of the engagement of at least one part of the locking element in the reception, the central part is arrested at the upper part such that the central part, respectively the carriage profile at which the central part is located, is prevented from being displaced. Preferably the reception in the upper part is configured as a depression, respectively as a groove. The reception is in particular configured to have a crescent-shaped form or a form in the shape of a segment of a circle, into which the preferably crescent-shaped or circle-segment-shaped locking element, in particular the first part of the locking element is able to positively engage.

An adjusting and interlocking unit is preferred in which the lower part includes an interlocking part, in particular an interlocking projection for the engagement in a second part of the locking element. The locking element may consist for example of a tenon, which protrudes from the lower part. In this case, the interlocking element protrudes from the lower part preferably vertically to the direction of rotation of the locking element. Thereby, the second part, in particular a second end of the locking element is able to reach engagement with the interlocking element, in order to arrest the central part at the lower part. In particular, the locking element and the interlocking element can be coordinated with each other so that, when reaching the third setting, the lower part and thereby the swing/sliding leaf are lifted by the locking element.

According to a preferred further aspect of the invention, it may be provided that the locking element includes a shape of a segment of a circle, or almost of a segment of a circle. It is preferred, if at least the second part, respectively the second end of the locking element, is configured to be crescent-shaped, such that, when reaching the third setting, for arresting purposes the locking element can engage behind the interlocking element, in particular behind the interlocking projection. In other words, it is preferred, if the locking element, in particular the second part, respectively the second end of the locking element includes a crescent-shaped projection for the engagement into the interlocking element, respectively for engaging behind the interlocking element of the lower part.

Furthermore, it may be provided advantageously in an adjusting and interlocking unit that the interlocking element is configured as a tenon, which protrudes from the lower part and around which a sleeve is rotatably supported. Thereby, the second part, respectively the second end of the locking element is able to very easily engage behind the interlocking element, in particular behind the tenon without occurrence of any frictional forces.

It may be furthermore provided in an adjusting and interlocking unit that the locking element includes a toothed ring segment and the adjusting mechanism includes a toothed wheel, wherein, for rotating the locking element, the toothed wheel is in operative engagement with the toothed ring segment. A defined movement of the locking element is guaranteed by the engagement of a toothed wheel of the adjusting mechanism in a toothed ring segment of the locking element. In particular the toothed ring segment is disposed in such a way at the locking element that the former is rotatable around the axis of rotation of the locking element. Thereby, the locking element can be rotated around the axis of rotation, when rotating the toothed wheel of the adjusting mechanism.

According to another preferred further aspect of the invention, in an adjusting and interlocking unit the adjusting mechanism includes a driving element, in particular a driving worm for rotating the locking element. In other words, the adjusting mechanism, in particular the toothed wheel can be actuated by a driving element in order to move the locking element into the first setting, the second setting or the third setting. It is preferred, if the driving element is configured for the engagement in the toothed wheel. The driving element can thus be configured as a driving worm, which can engage in the teeth of the toothed wheel. On account of the engagement of the driving worm in the toothed wheel, a rotational movement of the driving worm can be transferred onto the toothed wheel and thereby onto the locking element.

The driving element may be driven via a crank handle or electrically via a motor/gear unit. This means, in the simplest case, a crank handle may be inserted into the driving element, respectively into the driving worm such that the driving element can be actuated by a rotation of the crank handle. The crank handle may consist for example of a ball head hexagon socket screw wrench or include the same.

The upper part, the central part and the lower part of the adjusting and interlocking unit are preferably configured from light metal or from plastic material. This allows for reducing weight.

According to a second aspect of the invention, the problem is solved by a partition wall system. The partition wall system includes a roller rail, two or more displaceable and/or pivotable doors and/or walls, which are guided to be movable via rollers at/in the roller rail. Furthermore, the partition wall system includes for each door or wall at least one movable carriage profile at which one or more rollers are attached. In addition, the partition wall system includes an adjusting and interlocking unit for at least one of the doors or walls. In this case, the adjusting and interlocking unit is configured according to the first aspect of the invention. It is preferred, if the partition wall system includes a plurality of horizontal swing/sliding leaves which can be disposed in one row with regard to each other. Such a partition wall system allows for a user-friendly arresting of one or more of the swing/sliding leaves. Thereby, the partition wall system can be adjusted to any desired position in a simple and quick manner. As the adjusting and interlocking units can be easily manipulated, each swing/sliding leaf can be individually and quickly closed. That is, by its adjusting and interlocking unit, each swing/sliding leaf can be blocked by one of the three locking types. In other words, in the partition wall system it can be guaranteed in a user-friendly, simply and reliable manner that the displaceable and pivotable doors and/or walls can be positioned in one of the following conditions:

(1) Sliding is blocked and rotating is enabled, (2) Sliding and rotating are blocked, (3) Sliding is enabled and rotating is blocked.

The doors of the partition wall system are preferably made from glass. The walls are preferably made from light metal or from plastic material. In a preferred partition wall system, just doors, in particular glass doors may be provided. In another preferred partition wall system just walls may be provided. Likewise in a partition wall system, both doors and walls may be provided. Preferably, a roller rail is provided in the partition wall system. However, also several roller rails may be disposed aligned with each other. The roller rail may include corresponding rail branches. Each swing/sliding leaf is preferably guided to be movable at the roller rail, via two carriage profiles, with respectively at least one roller each. By the locking element of the adjusting and interlocking unit, the respective swing/sliding leaves can be easily transferred into the respective desired locking type. The adjusting of the setting of the locking element of an adjusting and interlocking unit is realized via the driving element of the respective adjusting and interlocking unit. The driving element may include a driving worm, which has a reception for a crank handle. As an alternative, the driving element may include a motor/gear unit such that the adjusting of the locking element may be realized electrically. The motor of the driving element may be likewise operated by a remote control. Thereby, the rotation of the locking element can be remotely controlled.

It is in particular preferred, if the aforementioned swing/sliding leaves are configured as horizontal swing/sliding leaves. Advantageously, the partition wall system is a partition wall system for horizontal swing/sliding leaves.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

Furthermore, the present invention will be further described with reference to the associated drawings. In the drawings.

DETAILED DESCRIPTION OF THE PRESENTLY PREFERRED EMBODIMENTS

Figure 1:
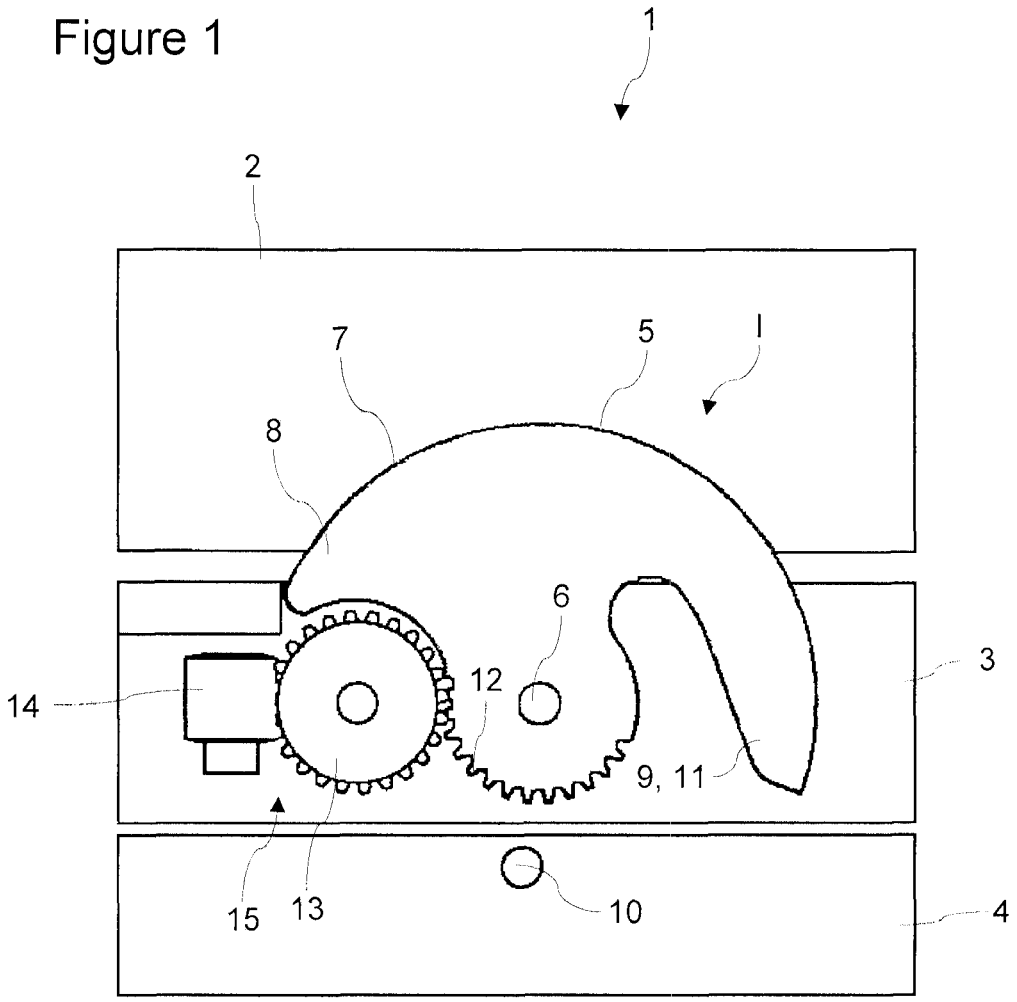
FIG. 1 shows an inventive adjusting and interlocking unit in a first setting in a lateral view.

Elements having the same functions and functionality are identified in the FIGS. 1 to 5 with the same reference numerals.

Figure 2:
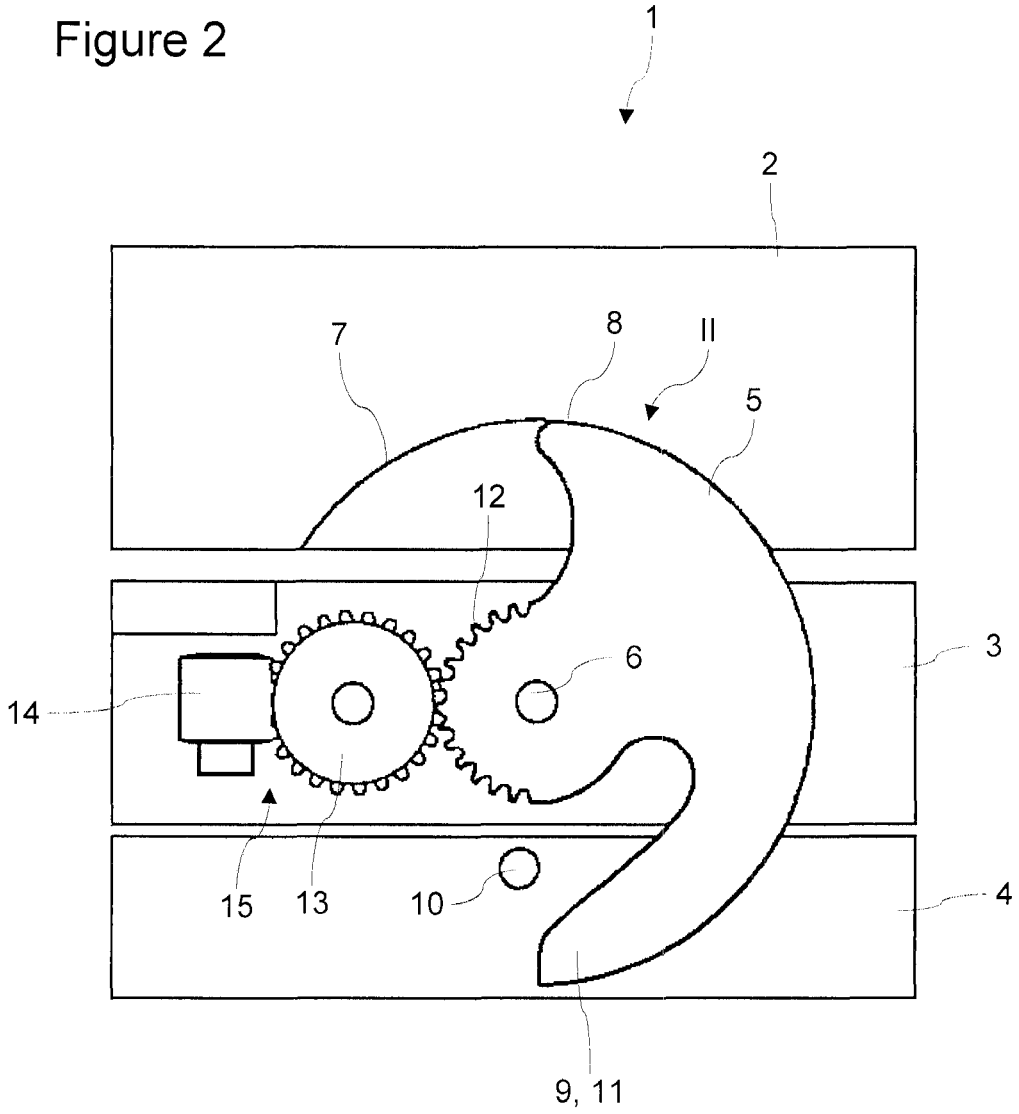
FIG. 2 shows the adjusting and interlocking unit of FIG. 1 in a second setting in a lateral view.
Figure 3:
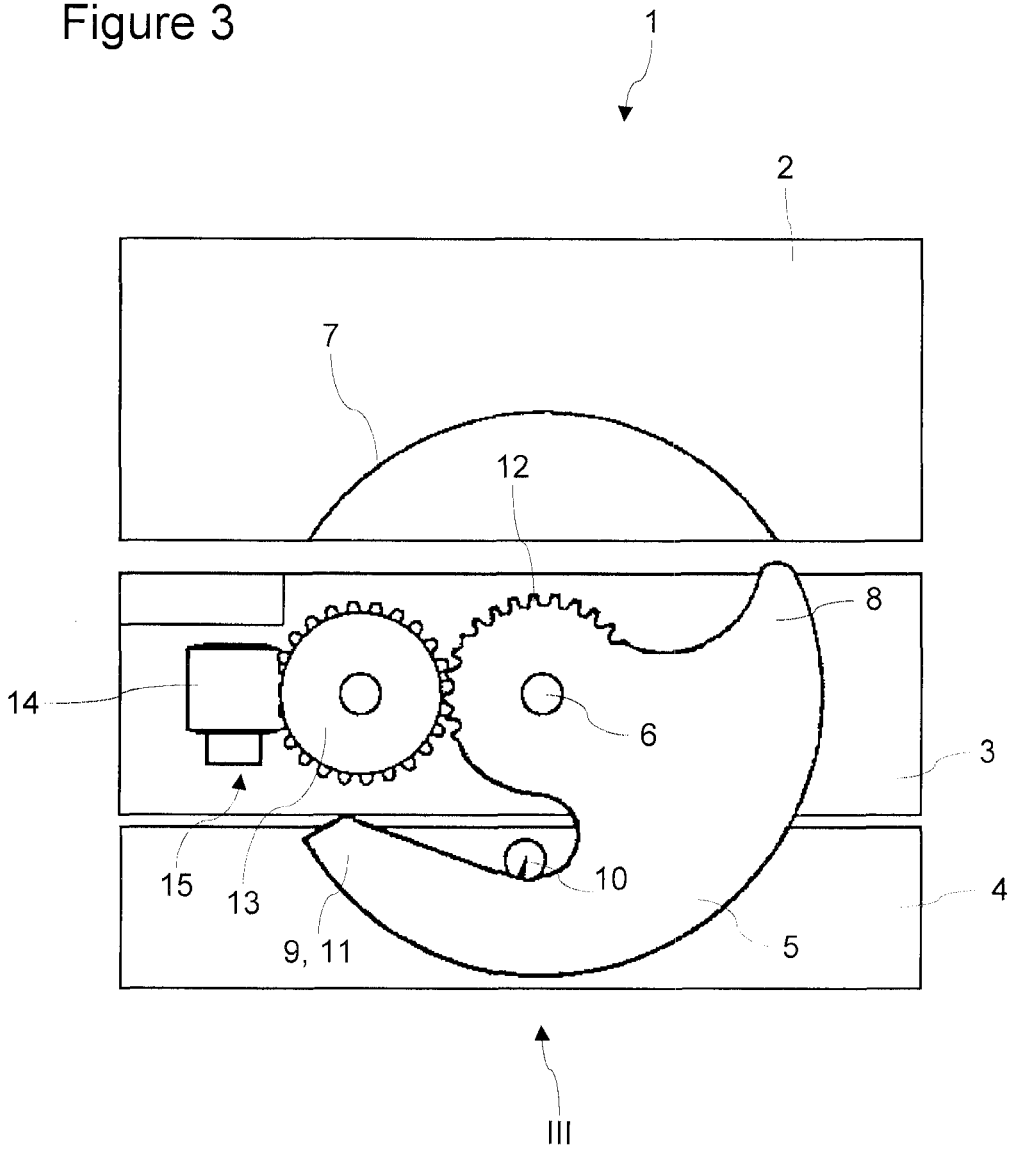
FIG. 3 shows the adjusting and interlocking unit of FIG. 1 in a third setting in a lateral view.

FIG. 1 shows an inventive adjusting and interlocking unit 1 for a displaceable and pivotable door or wall 20 (shown in FIG. 4) of a partition wall system in a first setting I, diagrammatically in a lateral view. FIG. 2 shows the inventive adjusting and interlocking unit 1 according to FIG. 1 in a second setting II, diagrammatically in a lateral view. FIG. 3 shows the inventive adjusting and interlocking unit 1 according to FIG. 1 in a third setting III, diagrammatically in a lateral view.

Figure 4:
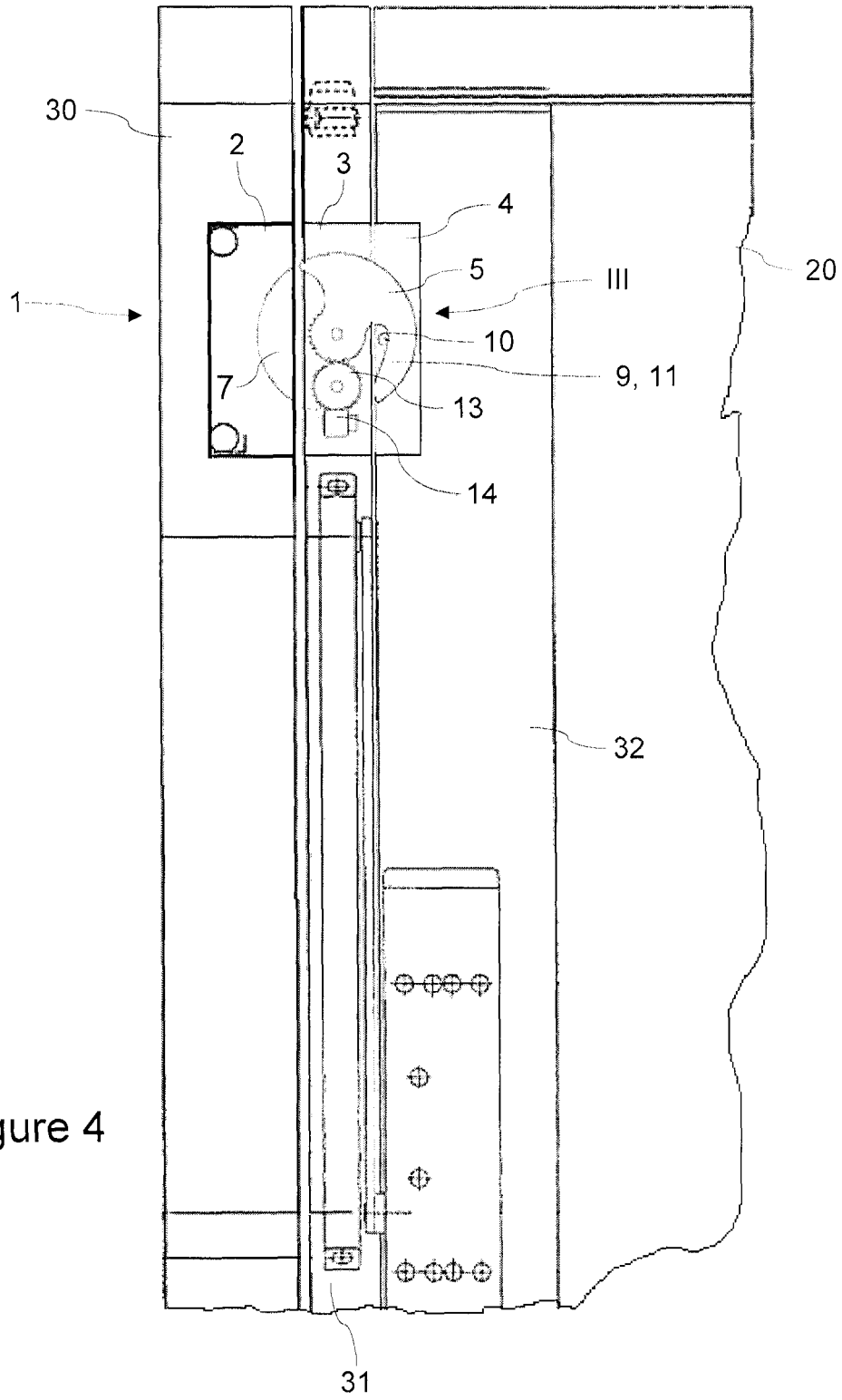
FIG. 4 shows the adjusting and interlocking unit of FIG. 1 in a third setting and attached to a roller rail, to a carriage profile and to a swing/sliding leaf of a partition wall system in a lateral view.

The adjusting and interlocking unit 1 includes an upper part 2, which can be attached to a roller rail 30 (visible in FIG. 4), a central part 3, which can be attached to a movable carriage profile 31 of the door, respectively of the wall 20, and a lower part 4, which can be attached to the door, respectively to the wall 20 itself. The roller rail 30, the carriage profile 31 and the displaceable and pivotable door/wall 20, likewise identified as the swing/sliding leaf, are illustrated in FIG. 4.

The adjusting and interlocking unit 1 includes a rotatably supported locking element 5 which is rotatably supported at the central part 3 around an axis of rotation 6. Furthermore, an adjusting mechanism 15 is provided for the rotation of the locking element 5 between the first setting I, the second setting II, and the third setting III. In the first setting I, for arresting the central part 3 at the upper part 2, the locking element 5 engages into the upper part 2, in this case into a reception 7 in the upper part 2, refer to FIG. 1. In the second setting II, for arresting the central part 3 at the upper part 2 and at the lower part 4, the locking element 5 engages in or at the upper part 2, in other words into the reception 7 of the upper part 2, and in or at the lower part 4, in this case in an interlocking element 10, which is configured as a tenon projecting from the lower part 4, refer to FIG. 2. A sleeve may be rotatably supported around the interlocking element 10, in particular around the tenon. Thereby, the locking element 5, in particular a second part 9, respectively a second end of the locking element 5 is able to engage particularly easily behind the interlocking element 10, in particular the tenon, without occurrence of any frictional forces. Preferably, the interlocking element 10 protrudes from the lower part 4 advantageously vertically to the direction of rotation of the locking element 5. Thereby, the second part 9, in particular a second end of the locking element 5 is able to easily reach engagement with the interlocking element 10, in order to arrest the central part 3 at the lower part 4. In particular, the locking element 5 and the interlocking element 10 can be coordinated with each other in such a way so that, when reaching the third setting III, as illustrated in FIG. 3, the lower part 4 and therefore the swing/sliding leaf 20 are lifted by the locking element 5.

The locking element 5 includes a form almost in the shape of a segment of a circle or a crescent-shaped form. In particular the second part 9, respectively a second end of the locking element 5, is configured to be crescent-shaped, such that, when reaching the third setting III, for arresting purposes the locking element 5 is able to engage behind the interlocking element 10, in particular the interlocking element 10 configured as a tenon. Thus, the second end includes in this case a crescent-shaped projection 11 for the engagement in the interlocking element 10, respectively for engaging behind the interlocking element 10 of the lower part 4.

Furthermore, the locking element 5 of the adjusting and interlocking unit 1 includes a toothed ring segment 12. The adjusting mechanism 15 of the adjusting and interlocking unit 1 includes a toothed wheel 13. For rotating the locking element 5, the toothed wheel 13 is in operative connection with the toothed ring segment 12. In other words, on account of the engagement of the toothed wheel 13 of the adjusting mechanism 15 in the toothed ring segment 12, a defined rotation of the locking element 5 around the axis of rotation 6 of the former is guaranteed.

Preferably, the adjusting mechanism 15 of the adjusting and interlocking unit 1 includes a driving element 14, in particular a driving worm for rotating a toothed wheel 13 and thereby the locking element 5. The toothed wheel 13 can be actuated by the driving element 14 in order to move the locking element 5 into the first setting I, the second setting II or the third setting III. The driving element 14, preferably configured as a driving worm, engages in the teeth of the toothed wheel 13. By the engagement of the driving worm 14 in the toothed wheel 13, a rotational movement of the driving worm 14 can be transferred onto the toothed wheel 13 and thereby via the toothed ring segment 12 onto the locking element 5.

There are several options for driving the driving element 14. Thus, the driving element 14 may be driven via a crank handle or electrically via a motor/gear unit. The crank handle may be for example a ball head hexagon socket screw wrench or may include a ball head hexagon socket screw wrench. A motor/gear unit may also be remotely controlled.

FIG. 4 shows the inventive adjusting and interlocking unit 1 in the third setting III in a lateral view. The upper part 2 of the adjusting and interlocking unit 1 is attached to the roller rail 30. The central part 3 of the adjusting and interlocking unit 1 is attached to the carriage profile 31, and the lower part 4 is attached to the swing/sliding leaf 20 of the partition wall system itself. In the third setting III, the swing/sliding leaf 20 can be displaced along the roller rail 30. A pivoting of the swing/sliding leaf 20 is blocked by the engagement of the locking element 5 in the tenon 10 at the swing/sliding leaf 20, respectively at a covering profile or at a frame attachment 32, in which the swing/sliding leaf 20 is disposed.

The swing/sliding leaf 20 and the adjusting and interlocking unit 1 are part of the partition wall system. The swing/sliding leaf 20 is preferably configured as a horizontal swing/sliding leaf 20. Advantageously, the partition wall system consists of a partition wall system for horizontal swing/sliding leaves 20.

The swing/sliding leaf 20 is guided to be movable via rollers at and/or in the roller rail 30. At least one movable carriage profile 31, to which one or more rollers are attached, is provided at the swing/sliding leaf 20. Preferably, the partition wall system includes a plurality of horizontal swing/sliding leaves 20, which can be disposed in one row with regard to each other. Such a partition wall system including swing/sliding leaves 20, which are retained at a roller rail 30 by inventive adjusting and interlocking units 1 allows for a user-friendly arresting of one or more swing/sliding leaves 20. By the easily adjusted locking element 5 of the respective adjusting and interlocking units 1, the partition wall system may be easily and simply set to each desired position. By the associated adjusting and interlocking unit 1, each swing/sliding leaf 20 may be set to one of three locking types:

(1) Sliding is blocked and rotating is enabled, (2) Sliding and rotating are blocked, (3) Sliding is enabled and rotating is blocked.

Figure 5:
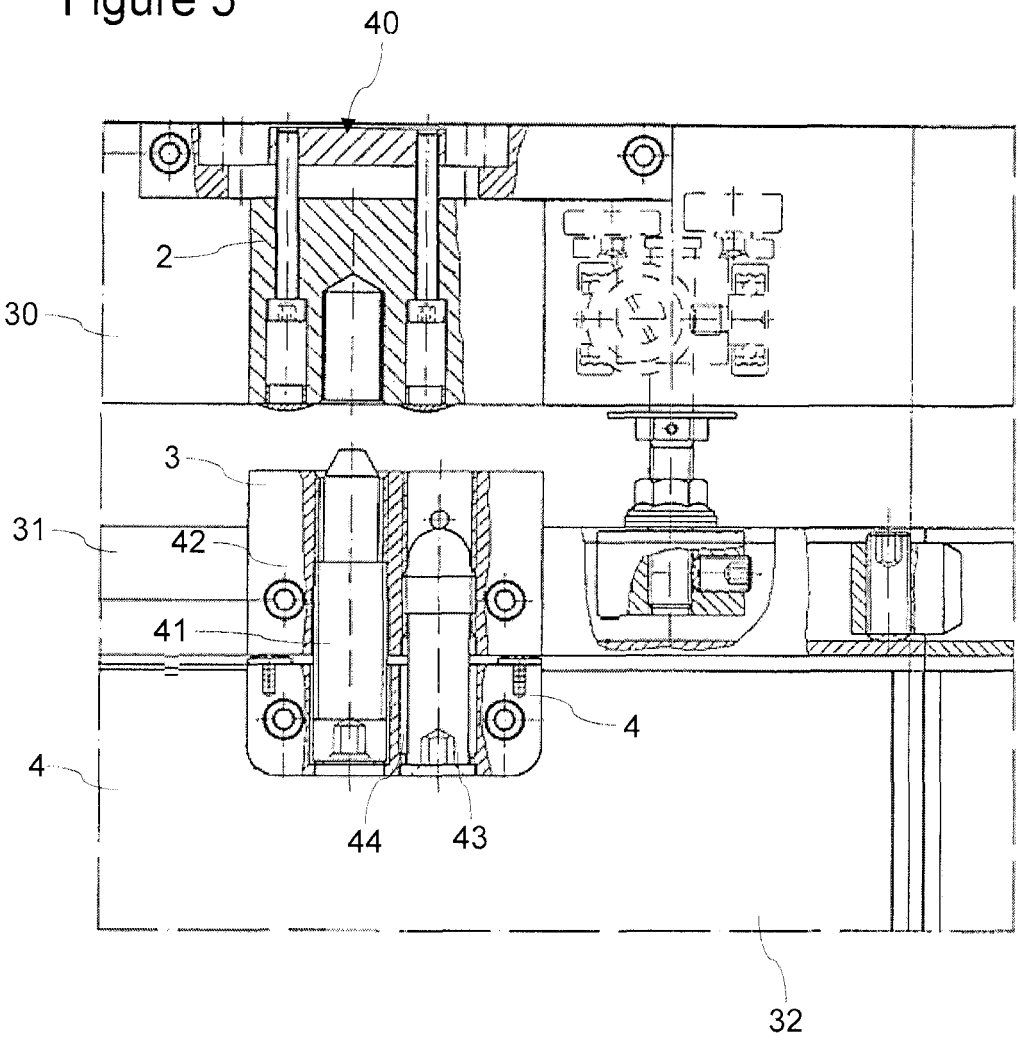
PRIOR ART Figure 5
FIG. 5 shows an adjusting and interlocking unit according to the state-of-the-art in a lateral view.

FIG. 5 shows an adjusting and interlocking unit 40 according to the state-of-the-art in a lateral view. In the partition wall system according to the state-of-the-art, setting the three locking types is realized by two screws, namely an arresting screw 41 and an interlocking screw 43. The screws 41, 43 are screwed into corresponding counter parts in the upper part 2, respectively the central part 3, by a rotational movement of their respective thread 42, 44. The screws 41, 43 are operated from the ground by an articulated crank handle, which, at its upper end, has a ball head hexagon socket screw wrench. Both the arresting screw 41 and the interlocking screw 43 can be screwed in or out by the ball head hexagon socket screw wrench. This conventional adjusting and interlocking unit 40 is disadvantageous in that for achieving one of the locking types, two screws 41, 43 have to be manipulated. In case one of the screws 41, 43 is not properly, in particular not completely screwed into the corresponding counter part at the upper part 2 or at the central part 3, the thread 42, 44 of the screw can be affected, can be destroyed in the worst case. Thereby, the corresponding screws 41, 43 can no longer be screwed into the upper part 2, respectively into the central part 3, and closing a swing/sliding leaf 20 can no longer be correctly performed.

The invention is not limited with respect to its construction to the preferred embodiment example indicated in the preceding. On the contrary, there are a number of conceivable variants which can be made use of by the demonstrated solution also in fundamentally different arrangements. All of the features and/or advantages, including constructional details or spatial arrangements, stemming from the claims, the description or the drawings may be essential to the invention both by themselves and in the most widely varying combinations. Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. An adjusting and interlocking unit (1) for displaceable and pivotable doors and/or walls (20), which are movably supported by a roller rail (30) via rollers, comprising:

an upper part (2) configured to be attachable to the roller rail (30);

a central part (3) configured to be attachable to a movable carriage profile (31) of a respective one of the pivotable doors and/or walls (20);

a lower part (4) configured to be attachable to the respective door and/or wall (20); and an arresting structure (5) rotatably supported at the central part (3), wherein:

the arresting structure (5) of the adjusting and interlocking unit (1) is adjustable so as to permit the adjusting and interlocking unit (1) to be configured to:

arrest, in a first setting (I), the central part (3) at the upper part (2), but not at the lower part (4), arrest, in a second setting (II), the central part (3) at the upper part (2) and at the lower part (4), and arrest, in a third setting (III), the central part (3) at the lower part (4), but not at the upper part (2), and wherein:

the arresting structure (5) comprises a rotatably supported locking element (5) having teeth, the rotatably supported locking element being supported at the central part (3) so as to be rotatable around an axis of rotation (6), the arresting structure (5) is adjustable by rotation of the locking element (5), the adjusting and interlocking unit (1) further comprises an adjusting mechanism (15) having teeth, the adjusting mechanism (15) being configured to rotate the locking element (5), by engagement between the teeth of the adjusting mechanism (15) and the teeth of the locking element (5), between respective first, second and third positions which correspond, respectively, to the first (I), the second (II), and the third settings (III), and the locking element (5):

in the first position, engages in or at the upper part (2) such that the adjusting and interlocking unit (1) is located in the first setting (I), in the second position, engages in or at the upper part (2) and in or at the lower part (4) such that the adjusting and interlocking unit (1) is located in the second setting (II), and in the third position, engages at the lower part (4) in or at the lower part (4), such that the adjusting and interlocking unit (1) is located in the third setting (III).

2. The adjusting and interlocking unit (1) according to claim 1, wherein the locking element (5) comprises a first part (8) and wherein the upper part (2) comprises a reception (7) comprising a depression or a groove configured to positively engage the first part (8) of the locking element (5).

3. The adjusting and interlocking unit (1) according to claim 2, wherein the locking element (5) comprises a second part (9) and wherein the lower part (4) includes an interlocking projection (10) configured to engage the second part (9) of the locking element (5).

4. The adjusting and interlocking unit (1) according to claim 1, wherein the locking element (5) is shaped substantially in the shape of a segment of a circle.

5. The adjusting and interlocking unit (1) according to claim 1, wherein the upper part (2), the central part (3) and the lower part (4) of the adjusting and interlocking unit (1) are made from metal or plastic material.

6. An adjusting and interlocking unit (1) for displaceable and pivotable doors and/or walls (20), which are movably supported by a roller rail (30) via rollers, comprising:

an upper part (2) configured to be attachable to the roller rail (30);

a central part (3) configured to be attachable to a movable carriage profile (31) of a respective one of the pivotable doors and/or walls (20);

a lower part (4) configured to be attachable to the respective door and/or wall (20); and an arresting structure (5) rotatably supported at the central part (3), wherein:

the arresting structure (5) of the adjusting and interlocking unit (1) is adjustable so as to permit the adjusting and interlocking unit (1) to be configured to:

arrest, in a first setting (I), the central part (3) at the upper part (2), but not at the lower part (4), arrest, in a second setting (II), the central part (3) at the upper part (2) and at the lower part (4), and arrest, in a third setting (III), the central part (3) at the lower part (4), but not at the upper part (2), wherein:

the arresting structure (5) comprises a rotatably supported locking element (5), supported at the central part (3) so as to be rotatable around an axis of rotation (6), the arresting structure (5) is adjustable by rotation of the locking element (5), the adjusting and interlocking unit (1) further comprises an adjusting mechanism (15) configured to rotate the locking element (5) between respective first, second and third positions which correspond, respectively, to the first (I), the second (II), and the third settings (III), and the locking element (5):

in the first position, engages in or at the upper part (2) such that the adjusting and interlocking unit (1) is located in the first setting (I), in the second position, engages in or at the upper part (2) and in or at the lower part (4) such that the adjusting and interlocking unit (1) is located in the second setting (II), and in the third position, engages at the lower part (4) in or at the lower part (4), such that the adjusting and interlocking unit (1) is located in the third setting (III), wherein the locking element (5) comprises a first part (8) and wherein the upper part (2) comprises a reception (7) comprising a depression or a groove configured to positively engage the first part (8) of the locking element (5), wherein the locking element (5) comprises a second part (9) and wherein the lower part (4) includes an interlocking projection (10) configured to engage the second part (9) of the locking element (5), and wherein the second part (9) of the locking element (5) comprises a crescent-shaped projection (11) for the engagement with the interlocking projection (10).

7. The adjusting and interlocking unit (1) according to claim 6, further comprising a sleeve, wherein the interlocking projection (10) comprises a tenon protruding from the lower part (4) and the sleeve is rotatably supported around the tenon.

8. An adjusting and interlocking unit (1) for displaceable and pivotable doors and/or walls (20), which are movably supported by a roller rail (30) via rollers, comprising:

an upper part (2) configured to be attachable to the roller rail (30);

a central part (3) configured to be attachable to a movable carriage profile (31) of a respective one of the pivotable doors and/or walls (20);

a lower part (4) configured to be attachable to the respective door and/or wall (20); and an arresting structure (5) rotatably supported at the central part (3), wherein:

the arresting structure (5) of the adjusting and interlocking unit (1) is adjustable so as to permit the adjusting and interlocking unit (1) to be configured to:

arrest, in a first setting (I), the central part (3) at the upper part (2), but not at the lower part (4), arrest, in a second setting (II), the central part (3) at the upper part (2) and at the lower part (4), and arrest, in a third setting (III), the central part (3) at the lower part (4), but not at the upper part (2), wherein:

the arresting structure (5) comprises a rotatably supported locking element (5), supported at the central part (3) so as to be rotatable around an axis of rotation (6), the arresting structure (5) is adjustable by rotation of the locking element (5), the adjusting and interlocking unit (1) further comprises an adjusting mechanism (15) configured to rotate the locking element (5) between respective first, second and third positions which correspond, respectively, to the first (I), the second (II), and the third settings (III), and the locking element (5):

in the first position, engages in or at the upper part (2) such that the adjusting and interlocking unit (1) is located in the first setting (I), in the second position, engages in or at the upper part (2) and in or at the lower part (4) such that the adjusting and interlocking unit (1) is located in the second setting (II), and in the third position, engages at the lower part (4) in or at the lower part (4), such that the adjusting and interlocking unit (1) is located in the third setting (III), and wherein:

the locking element (5) includes a toothed ring segment (12), the adjusting mechanism (15) includes a toothed wheel (13), and the toothed wheel (13) is configured to operatively connect with the toothed ring segment (12) to cause rotation of the locking element (5).

9. The adjusting and interlocking unit (1) according to claim 8, wherein the toothed ring segment (12) is disposed on the locking element (5) such that the locking element (5) is rotatable around the axis of rotation (6) of the locking element (5).

10. The adjusting and interlocking unit (1) according to claim 8, wherein the adjusting mechanism (15) includes a driving element (14) configured to rotate the locking element (5).

11. The adjusting and interlocking unit (1) according to claim 10, wherein the driving element (14) is configured to engage the toothed wheel (13).

12. The adjusting and interlocking unit (1) according to claim 11, wherein the driving element (14) is configured to be drivable via a crank handle or electrically via a motor and gear unit.

13. The adjusting and interlocking unit (1) according to claim 10, wherein the driving element (14) is a driving worm.

14. A partition wall system, including a roller rail (30), two or more displaceable and pivotable doors and/or walls (20), which are movably supported by a roller rail (30) via rollers, and for each door or wall (20) at least one movable carriage profile (31) at which one or more of the rollers are attached, as well as, for at least one of the doors or walls (20), an adjusting and interlocking unit (1), wherein the at least one adjusting and interlocking unit (1) is configured according to claim 1.

* * * * *